US007546702B2

(12) United States Patent
Malkovas

(10) Patent No.: US 7,546,702 B2
(45) Date of Patent: Jun. 16, 2009

(54) ADVERTISING/PROMOTIONAL DISPLAY SYSTEM

(75) Inventor: Mykolas Malkovas, Essex, CT (US)

(73) Assignee: Structural Graphics LLC, Essex, CT (US)

( * ) Notice: Subject to any disclaimer, the term of this patent is extended or adjusted under 35 U.S.C. 154(b) by 105 days.

(21) Appl. No.: 11/653,709

(22) Filed: Jan. 16, 2007

(65) Prior Publication Data

US 2007/0169388 A1 Jul. 26, 2007

Related U.S. Application Data

(60) Provisional application No. 60/760,701, filed on Jan. 20, 2006.

(51) Int. Cl.
*G09F 1/00* (2006.01)

(52) U.S. Cl. ..... 40/124.08; 446/148

(58) Field of Classification Search ..... 40/124.08, 40/610; 446/92, 108–116; 434/73; 273/157; 229/108, 108.1, 117.03, 117.25, 120.08, 229/120.15, 152

See application file for complete search history.

(56) References Cited

U.S. PATENT DOCUMENTS 4,558,866 A * 12/1985 Alford ..... 273/153 S
4,794,024 A * 12/1988 Crowell et al. ..... 428/12
5,651,715 A * 7/1997 Shedelbower ..... 446/137
5,937,553 A 8/1999 Maran
D457,833 S * 5/2002 Juan et al. ..... D11/121
6,578,303 B2 * 6/2003 Richards ..... 40/665

* cited by examiner

*Primary Examiner*—Paul N Dickson
*Assistant Examiner*—Shin Kim
(74) *Attorney, Agent, or Firm*—Melvin I. Stoltz

(57) ABSTRACT

By providing a unique, preprinted housing member which automatically expands from a flat, generally two-dimensional configuration into a three-dimensional promotional display, and is securely maintained in the three-dimensional configuration for any desired time duration, a unique, hands-on, printed, long-lasting visually exciting and interest-generating advertising/promotional product is obtained. In the present invention, the self-erecting, promotional display member incorporates small magnetic members mounted to internal panels, struts or support walls of the display member, with the magnetic members being positions for being automatically activated simultaneously with the movement of the display member from its two-dimensional configuration into its three-dimensional configuration. Once activated, the magnetic members are brought into locked engagement with each other, securely holding the display member in its fully erect, three-dimensional display configuration.

19 Claims, 3 Drawing Sheets

20

20

20

20

20

20

20

20

ADVERTISING/PROMOTIONAL DISPLAY SYSTEM

RELATED APPLICATIONS

This application is related to U.S. Provisional Patent Application Ser. No. 60/760,701, filed Jan. 20, 2006 entitled ADVERTISING/PROMOTIONAL DISPLAY SYSTEM.

TECHNICAL FIELD

This invention relates to advertising and promotional display systems and, more particularly, to advertising/promotional display systems which are movable between a substantially flat configuration and a three-dimensional, fully erected and secured display configuration.

BACKGROUND ART

With the ever increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention.

Although various novelty products and printed displays have been created in an attempt to satisfy this demand, these prior art products have failed to provide the desired interest generating results with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display.

Another drawback found in prior art systems is their inability to provide a product which is movable from a substantially flat, two-dimensional configuration into a three-dimensional configuration while also being automatically secured in the three-dimensional, fully erect, display configuration with a long-lasting, non-degradable and non-deformable holding member. Typically, prior art products which have an automatically initiated holding member employ conventional rubber bands for maintaining the display in the fully erect configuration. Unfortunately, rubber bands are not long-lasting and degrade over time. Furthermore, repeated use of these prior art rubber bands causes stretching, which results in the rubber band becoming elongated or stretched, losing tension and the ability to maintain the three-dimensional display in the original, fully erect, display position.

In addition, the amount of force produced by the incorporation of rubber bands in these displays requires the use of heavy board paper stock or cardboard in order to provide the required support and/or strength for the rubber bands and the forces generated thereby. As a result, these prior art products are inherently more expensive and difficult to produce.

Therefore, it is a principal object of the present invention to provide a printed advertising or promotional product which is capable of being produced at a reasonable cost and provides an exciting, interest-generating display.

Another object of the present invention is to provide a printed advertising or promotional product having the characteristic features described above, which enables the consumer to physically control the presentation of the display in a unique hands-on manner.

Another object of the present invention is to provide a printed advertising or promotional product having the characteristic features described above which is capable of mass production and assembly.

A further object of the present invention is to provide a printed advertising or promotional product having the characteristic features described above which provides a unique, eye-catching, exciting and surprising display which is produced in response to action by the consumer.

Another object of this invention is to provide a printed advertising or promotional product having the characteristic features described above which employs an automatically activated fastening and holding assembly which does not degrade or lose its holding capabilities over time, thereby ensuring continuous, long-lasting results.

Another object of the invention is to provide a printed advertising or promotional product having the characteristic features described above which is capable of being manufactured from conventional paper stock while still possessing all of the desired automatic, self-erecting features.

Another object of the present invention is to provide a printed advertising or promotional product having the characteristic features described above which achieves all of the above identified enhanced features while also being capable of manufacture at extremely competitive costs.

Other and more specific objects will in part be obvious and will in part appear hereinafter.

SUMMARY OF THE INVENTION

By employing the present invention, all of the difficulties and inabilities of the prior art are eliminated and a unique, hands-on, printed, long-lasting visually exciting and interest-generating advertising/promotional product is obtained. These desirable results are achieved in the present invention by providing a unique, preprinted housing member which automatically expands from a flat, generally two-dimensional configuration into a three-dimensional promotional display, and is securely maintained in the three-dimensional configuration for any desired time duration. In addition, in order to further enhance the excitement and interest generated by the promotional product of the present invention, the holding members incorporated in the promotional display member are automatically activated simultaneously with the movement of the display member from its substantially flat, planar configuration into its three-dimensional configuration and are virtually incapable of suffering degradation or loss of holding strength.

In accordance with the present invention, a housing is provided which is constructed for automatic, self-initiated, pop-up display from a first, substantially flat, two-dimensional configuration into a second, fully displayed three-dimensional configuration, with the locking members being automatically activated for maintaining the promotional display member in the three-dimensional position. In the present invention, the self-erecting, promotional display member incorporates small magnetic members mounted to internal panels, struts or support walls of the display member, with the magnetic members being positions for being automatically activated simultaneously with the movement of the display member from its two-dimensional configuration into its three-dimensional configuration. Once activated, the magnetic members are brought into locked engagement with each other, securely holding the display member in its fully erect, three-dimensional display configuration.

In the present invention, the visually exciting, interest generating, advertising/promotional display member comprises a multi-paneled or three-dimensional component formed in any desired size or shape. In accordance with the present invention, selected panels are interconnected to each other in order to enable the display member to be storable in a substantially flat configuration and, when activated, automatically expand or pop-up into a three-dimensional configuration. By simply moving the display member from its two-dimensional configuration toward its three-dimensional configuration, the cooperating magnetic members mounted to the internal panels or walls causes the display member to be drawn into the three-dimensional configuration and automatically locked in the desired, fully erect, three-dimensional display configuration.

In the present invention, each panel forming the display member incorporates an eye-catching visual display for generating consumer interest in the particular product for which the display has been created. In this way, once the display member has been formed into its fully constructed three-dimensional configuration, all of the panels forming the display member are presented in an easily viewable position, adjacent to each other, in order to provide the eye-catching, visually exciting and interest generating material contained thereon.

In accordance with the present invention, consumer interest and excitement is substantially enhanced and greater attention for the display member of the present invention is realized by incorporating into the display member holding/locking means which are automatically activated upon movement of the display member from its first, substantially flat configuration into its second, fully constructed, three-dimensional display configuration. In addition, by providing locking means which are virtually non-degradable, the display member remains in its fully erect, three-dimensional configuration for any desired time period, while also assuring repeated movement of the display system between two-dimensional and three-dimensional configuration without any loss in visual appearance, speed or ease of operation.

In accordance with the present invention, the locking means incorporated into the display member preferably comprises a pair of cooperating magnets, each of which are mounted on panel or wall members mounted inside the display member. In addition, the panel/wall members on which the magnets are mounted are positioned for movement from a substantially flat, two-dimensional configuration into a fully erect, three-dimensional configuration wherein the panel/wall members are brought into juxtaposed, cooperating relationship with each other. Furthermore, the magnet members are positioned on the panel/wall members in order to assure that the cooperating magnets are brought in contact with each other whenever the display member is moved from its two-dimensional configuration into its three-dimensional configuration.

In a preferred embodiment, each of the magnets or magnetic members comprise thin, magnetic wafer-like constructions, which are lightweight and easily affixed to the interior support panels or walls of the display member. In addition, the magnets are mounted to the support panels/walls in any manner which assures that the outer or exposed surface of a first magnet will attract the outer or exposed surface of a second magnet, thereby assuring secure, contact and interengagement of the magnetic members whenever the members are brought into close proximity to each other.

Furthermore, by constructing the magnetic members in a manner which provides enhanced, strong attractive forces to be generated by each magnetic member as each magnetic member is brought into close proximity to the other magnetic member, a high degree of automatic, self-erecting construction is realized. In this regard, whenever the display member is moved from its first, two-dimensional configuration into the initial stages of its three-dimensional configuration, wherein the magnetic members are placed in reasonably close proximity to each other, the strong attractive forces of the magnetic members will cause the display member to be automatically moved into the fully erect, three-dimensional configuration. In this way, automatic, secure placement of the display member in the desired fully erect, three-dimensional configuration is easily achieved.

In the preferred construction of the present convention, the internal support panels/walls on which the magnetic members are mounted may be constructed in a wide variety of alternate positions and configurations. However, in the preferred embodiment, the panel/wall members are constructed to move from a substantially flat, two-dimensional configuration, into a three-dimensional configuration, with a portion of the first panel/wall member upon which a first magnetic member is mounted being automatically placed or positioned in juxtaposed, cooperating relationship with a portion of the second panel/wall member upon which a second magnetic member is mounted. In this way, assurance is provided that the two, cooperating, magnetic members are brought into alignment with each other in order to provide the desired contact and secure interengagement.

As is fully detailed herein, at least one interior movable panel/wall member must be secured to a panel or wall of the display member for each magnetic member employed in achieving the advertising/promotional display system of the present invention. However, depending upon the construction employed for the display system, many embodiments will employ a generally L-shaped, Z-shaped, or H-shaped panel/wall member for each magnetic member secured thereto. Furthermore, as fully detailed herein, further alternate constructions and combinations of panel/wall members and folding configurations can be employed without departing from the scope of the present invention.

Regardless of the configuration employed, each embodiment of the present invention employs at least two cooperating panel/wall members affixed to different locations of the interior of the advertising/promotional display system, with each panel/wall member incorporating an automatically initiated locking/holding member affixed thereto. In addition, the panel/wall members are positioned for being brought into cooperating relationship with each other, with the automatically initiated, locking/holding members mounted to each panel member being brought into secure, locking contact with each other whenever the advertising/promotional display system is moved from its two-dimensional configuration into its three-dimensional configuration.

In this way, the advertising/promotional display system is quickly and easily formed into its fully displaying three-dimensional configuration while also being automatically locked in this position for long-term display, enabling all users and observers to completely enjoy and benefit from the indicia formed on the advertising/display system. As a result, an advertising/promotional display member is attained which is capable of satisfying advertisers demands for a new, unique, long-lasting, easily employed, interest generating promotional product.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figures 1, 2, 3, 4, 5:
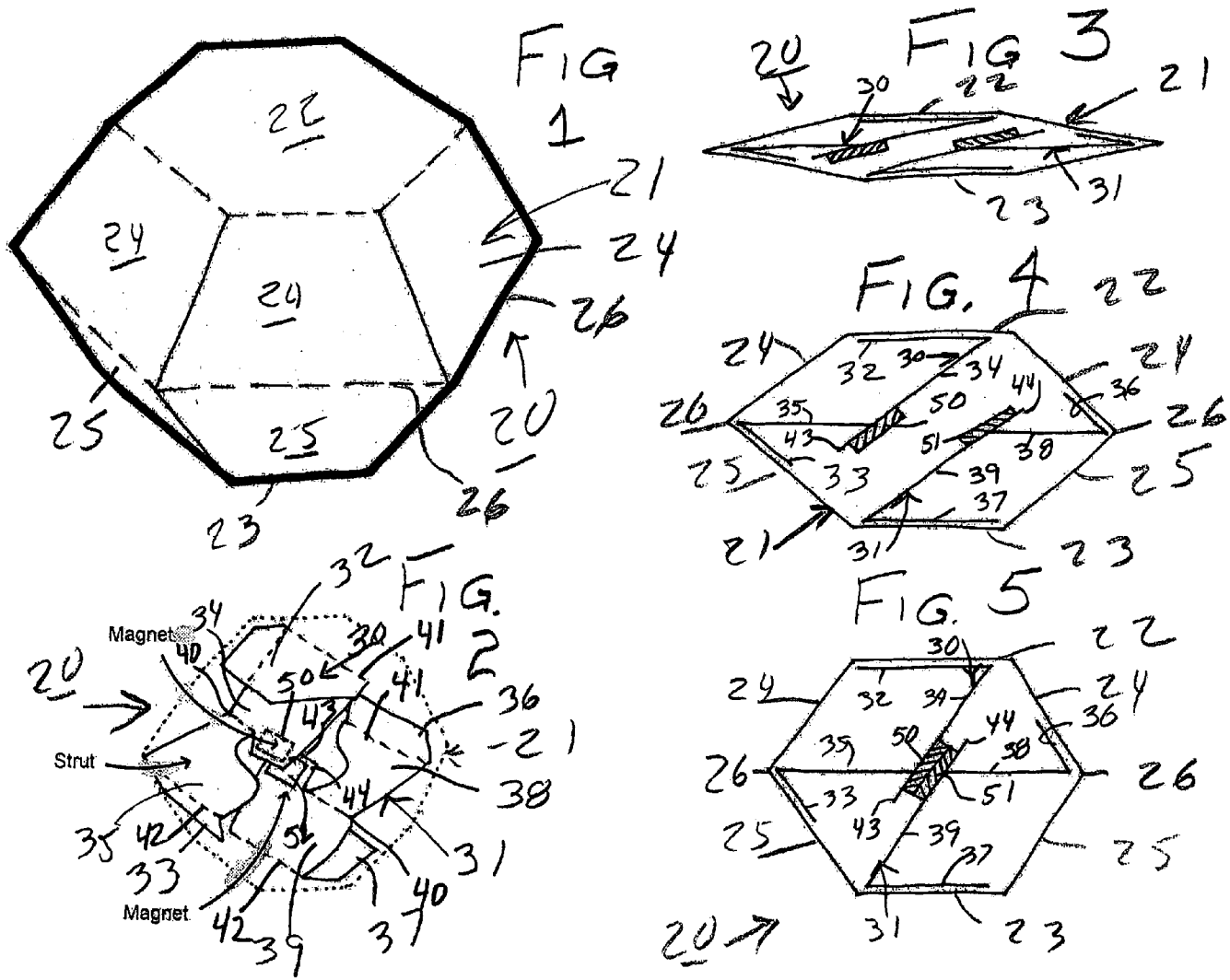
FIG. 1 is a perspective view of one embodiment of the advertising/promotional display member of the present invention depicted as a polyhedron in its three-dimensional, fully constructed display configuration.
FIG. 2 is a perspective view of the embodiment of FIG. 1 with the outer surfaces thereof shown in phantom and the internal support panels or walls thereof fully depicted.
FIGS. 3-5 are cross-sectional side elevation views of the polyhedron embodiment of FIG. 1 showing the embodiment in various stages of movement from its two-dimensional, collapsed position to its fully displayed, three-dimensional position.
Figures 6, 7, 8, 9, 10, 11:
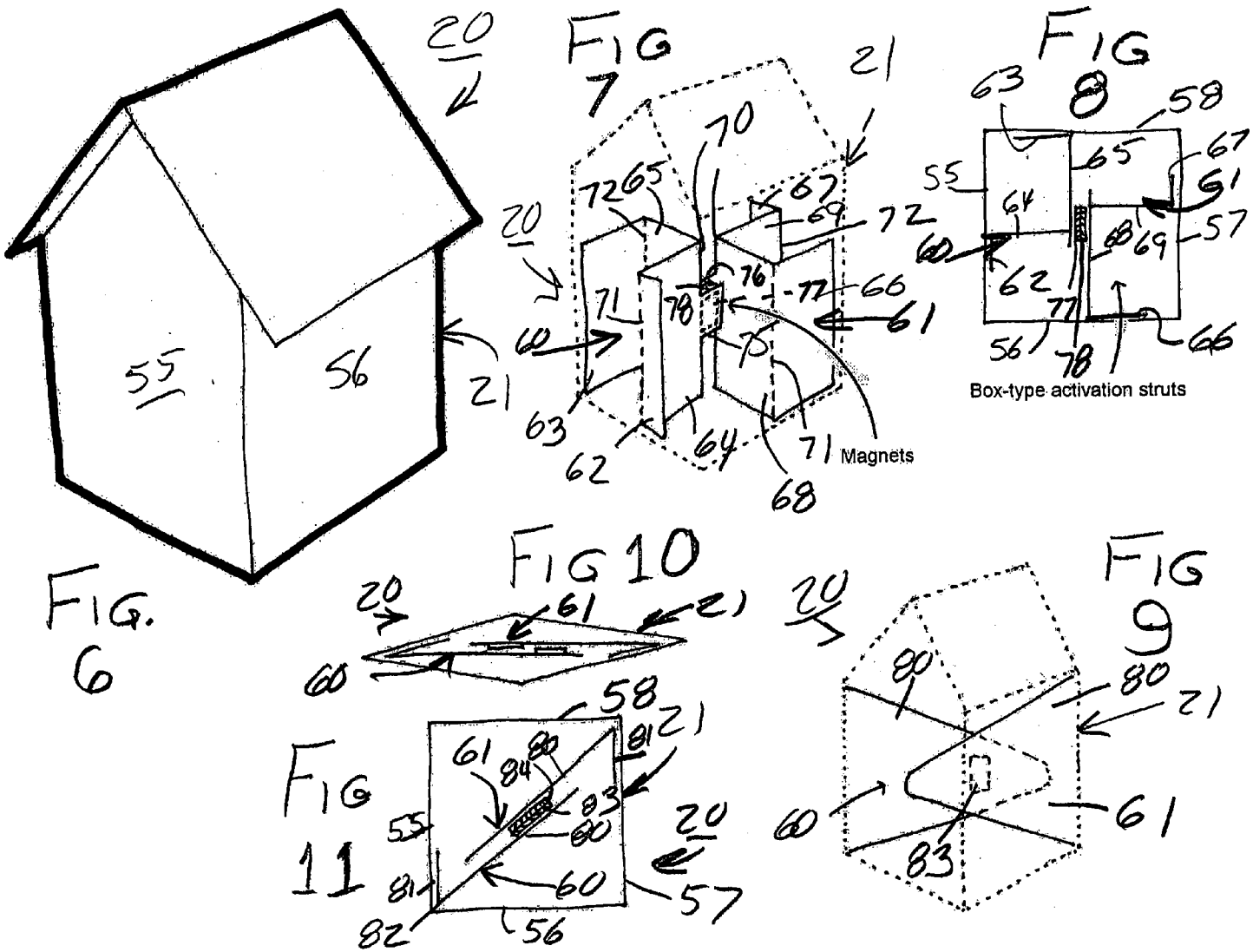
FIG. 6 is a perspective view of an alternate embodiment of the advertising/promotional display member of present invention depicted as a house or building and shown in its three-dimensional, fully displayed configuration.
FIG. 7 is a perspective view of the embodiment of FIG. 6 with the outer surfaces thereof shown in phantom and the internal support panels or walls thereof fully depicted.
FIG. 8 is a cross-sectional top plan view of the embodiment of FIG. 7, depicting the support panels in their fully erect and displayed position.
FIG. 9 is a perspective view of an alternate construction for the embodiment of FIG. 6 with the outer surface of the advertising/promotional display member depicted in phantom and with the internal support panels or walls shown fully depicted.
FIG. 10 is a cross-sectional top plan view of the embodiment of FIG. 9 shown in its collapsed, two-dimensional position.
Figures 12, 13, 14, 15, 16, 17, 18, 19:
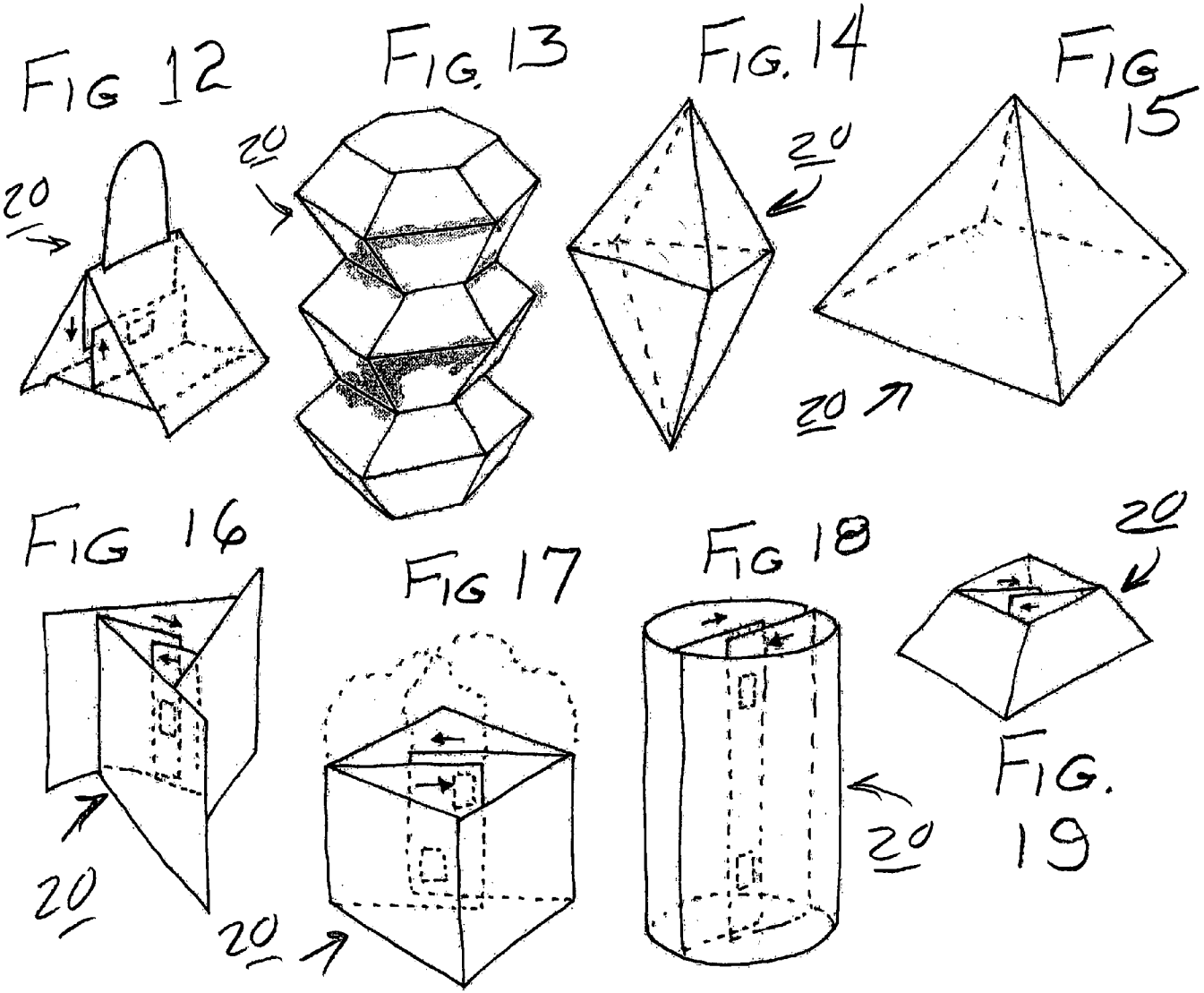

FIG. 11 is a top plan view of the embodiment of FIG. 9 shown in its fully erect, three-dimensional position; and FIGS. 12-19 are perspective views of various alternate embodiments of the advertising/promotional display member of the present invention with each embodiment depicting an alternate construction and configuration of the present invention shown in a fully erect, three-dimensional position.

DETAILED DISCLOSURE

By referring to FIGS. 1-19, along with the following detailed discussion, the construction and operation of several alternate embodiments for the present invention can best be understood. In addition to these alternate embodiments, further alternate embodiments and constructions can be implemented using the teaching of the present invention. Consequently, it is to be understood that the following detailed disclosure and the specific embodiments shown herein are provided for exemplary purposes only and are not intended as a limitation of the scope of the present invention.

In FIGS. 1-5, one preferred embodiment of the advertising/promotional display system 20 of the present invention is fully depicted. In this embodiment, advertising/promotional display system 20 comprises housing 21 which is formed as a multi-surfaced, polyhedron. In the preferred construction depicted, housing 21 comprises top panel 22, and bottom panel 23, both of which are formed in a hexagonal shape.

In addition, housing 21 also comprises a plurality of upper sidewalls 24 and lower sidewalls 25, with sidewalls 24 and 25 preferably affixed to each other along fold line 26. In addition, each upper sidewall 24 is affixed along its top edge to one the edges of hexagonal shaped top panel 22, while each lower sidewall 25 is affixed along its bottom edge to one edge of bottom panel 23. In this way, each pair of upper sidewalls 24 and lower sidewalls 25 operate independently of each adjacent pair of upper sidewalls 24 and lower sidewalls 25, with each pair being capable of flexing outwardly from top panel 22 and bottom panel 23 as housing 21 is moved from a two-dimensional configuration into a three-dimensional configuration.

In this embodiment, six separate, independent pairs of upper sidewalls 24 and lower sidewalls 25 are employed for peripherally surrounding and extending from each edge of hexagonally shaped top panel 22 and bottom panel 23. Furthermore, when housing 21 is in its fully displayed, three-dimensional configuration, the free edges of each pair of sidewalls 24 and 25 are in contact with the free edges of each adjacent pair of sidewalls 24 and 25. In this way, housing 21 appears to be a fully constructed, solid element when in its three-dimensional configuration, while also being easily movable into a substantially flat, two-dimensional configuration, whenever desired by the user.

In the preferred construction of the present invention, the outside surfaces of all of the panels forming housing 21 incorporate eye catching, interest generating, visually exciting indicia printed thereon. In this way, the desired message sought to be conveyed by the sponsor of display system 20 is able to be presented in a manner which is readily seen and understood by the user. In addition, by achieving advertising/promotional display system 20 made in accordance with the present invention, the fully erect, three-dimensional, displaying configuration is capable of being quickly and easily established and securely retained for an extended time period, without suffering any degradation or loss in its visually attractive construction.

In order to achieve the desired, secure affixation of housing 21 in its fully erect, visually displaying, three-dimensional position, housing 21 incorporates two strut forming, foldable panel or wall members 30 and 31 which are mounted within housing 21 and securely affixed to interior wall panels thereof. Although a wide variety of alternate constructions and configurations can be successfully implemented for achieving the desired securement of housing 21 in its three-dimensional, fully erect displaying configuration, the preferred construction employed in accordance with the present invention is detailed herein.

As fully depicted in FIGS. 2-5, strut forming, foldable panel/wall member 30 incorporates end sections 32 and 33 and intermediate sections 34 and 35. Similarly, strut forming, foldable panel/wall member 31 incorporates end sections 36 and 37 and intermediate sections 38 and 39. In the preferred construction, strut forming, foldable panel/wall members 30 and 31 are both formed from a single, elongated sheet of material with intermediate sections 34/35 and 38/39 being interconnected to each other along fold line 40.

Similarly, both end section 32 and intermediate section 34 of panel/wall member 30, and end section 36 and intermediate section 38 of panel/wall member 31 are connected to each other along fold line 41. Finally, end section 33 and intermediate section 35 of panel/wall member 30 and end section 37 and intermediate section 39 of panel/wall member 31 are interconnected to each other along fold line 42. As is more fully detailed below, by incorporating this construction, each of the sections forming panel/wall members 30 and 31 are capable of being arcuately pivoted relative to each other in order to enable housing 21 to quickly and easily move from a fully folded, two-dimensional position to its fully displayed, three-dimensional position.

In completing the construction of this preferred embodiment of the present invention, strut forming, foldable panel/wall member 30 incorporates tab or flange 43 which forms a part of intermediate section 34 directly adjacent fold line 40, with tab/flange 43 extending from section 34 and being separate and independent of intermediate sections 34 and 35. As depicted, tab/flange 43 extends from intermediate section 34 and is defined by its free, peripherally surrounding edges. Similarly, strut forming, foldable panel/wall member 31 incorporates tab/flange 44 which forms a part of intermediate section 39, positioned directly adjacent fold line 40, with tab/flange 44 being separate and independent of intermediate sections 38 and 39. Tab/flange 44 extends from intermediate section 39 and is defined by its free, peripherally surrounding edges.

In order to provide the desired secure, locked interengagement and display supporting construction detailed above, tab/flange 43 incorporates magnetic member 50 securely affixed thereto, while tab/flange 44 incorporates magnetic member 51 securely affixed thereto. Furthermore, magnetic members 50 and 51 are positioned on tabs/flanges 43 and 44 in order to assure that magnetic members 50 and 51 are placed in secure, aligned, abutting contacted relationship with each other whenever housing 21 is arcuately pivoted into its fully displayed, three-dimensional configuration. In this way, direct contact between magnetic members 50 and 51 is assured and the secure, locked affixation of housing 21 in its fully erect, three-dimensional position is provided.

Although magnetic members 50 and 51 may be constructed in a wide variety of alternate configurations, or may be constructed from a wide variety of alternate materials which will provide the desired locking contact and engagement of flanges 43 and 44 with each other, the preferred embodiment employs thin, wafer-like magnets as magnetic members 50 and 51. By employing this construction, a lightweight, easily constructed, dependable and virtually indestructible locking construction is realized which is capable of achieving all of the desired goals and objectives previously unattainable with prior art constructions.

As a clearly depicted in the drawings, this embodiment of the present invention achieves the desired movement from a substantially flat, two-dimensional position to a fully erect, displaying, three-dimensional position which is automatically secured and maintained in the three-dimensional position for any desired length of time, without degradation or loss of visual impact, by securely affixing strut forming foldable panels/wall members 30 and 31 to cooperating interior surfaces of housing 21. In this regard, although a wide variety of alternate positions and configurations can be employed using the construction detailed above for strut forming foldable panel/wall members 30 and 31, it has been found that the desired results are most expeditiously attained by affixing end section 32 of panel/wall member 32 to the interior surface of top panel 22, while end section 33 of panel/wall member 30 is affixed to one of the lower side walls 25 of housing 21.

Similarly, end section 36 of panel/wall member 31 is affixed to one of the upper sidewalls 24 of housing 21, while end section 37 of panel/wall member 31 is secured to bottom panel 23. By mounting panel/wall members 30 and 31 in the manner detailed above and positioning the panel/wall members in juxtaposed, spaced, facing relationship with each other, the desired movement of panel/wall members 30 and 31 from a fully collapsed two-dimensional position to a fully erect and locked three-dimensional position is easily attained.

As is evident from the foregoing detailed discussion, the present invention achieves the creation of advertising/promotional display system 20 in a manner which enables display system 20 to be quickly and easily moved from a two-dimensional configuration into a three-dimensional configuration, with the three-dimensional configuration being automatically securely locked in the desired fully erect configuration by the interengagement of magnetic members 50 and 51 due to the inherent attractive forces provided thereby. As a result, once any user initiates the movement of advertising/promotion display system 20 from its two-dimensional position into its three-dimensional position, the inherent attractive forces of magnetic members 50 and 51 cause display system 20 to be automatically moved into a fixed, locked contacting engagement with each other, placing advertising/promotional display system 20 in the desired, fully erect, three-dimensional displaying configuration. In addition, since magnetic members 50 and 51 are incapable of degradation, the three-dimensional display provided thereby is maintained indefinitely, or for as long as the user desires.

In accordance with the present invention, advertising/promotional display system 20 may be created in any visual configuration desired by a user in order to achieve an eye-catching, visually distinctive, meaningful promotional display. In addition, regardless of the configuration in which display system 20 is formed, the incorporation of strut forming, foldable panels/wall members, which incorporate magnetic members affixed thereto, enables the resulting display system 20 to achieve a long-lasting, easily erected advertising/promotional product using the teaching of the present invention.

In this regard, FIGS. 6-11 depict advertising/promotional display system 20 constructed as a building or house, with two alternate strut forming, foldable panel/wall member configurations being employed to achieve the desired displayed configuration. As a result, by referring to FIGS. 6-11, along with the following detailed discussion, these alternate constructions can best be understood, as well as the unique versatility and broad applicability of the present invention to numerous advertising/promotional display constructions and configuration.

As shown, advertising/promotional display system 20 comprises housing 21 which is constructed to visually represent a house or building. In this embodiment, housing 21 incorporates side panels 55, 56, 57 and 58, each of which form one of the sidewalls of the house or building. In the preferred construction, panels 55, 56 to 57, and 58 are each interconnected with each other, in order to enable housing 21 to be easily collapsed into a substantially two-dimensional configuration, while also being quickly and easily moved from its two-dimensional position into its fully erect, displaying, three-dimensional position. In addition, any desired message, symbol, colors, pictures, or other indicia can be printed on the outer surface of walls 55, 56, 57, and 58, in order to achieve and provide the desired eye-catching, visually distinctive display.

In order to maintain housing 21 in its fully erect, displaying, three-dimensional position, advertising/promotional display system 20 incorporates strut forming, foldable interior panels or wall members 60 and 61. In this embodiment, panel/wall members 60 and 61 preferably comprise an elongated sheet of material which is folded into a plurality of sections which are pivotally mounted relative to each other. In this regard, panel/wall member 60 comprises end sections 62 and 63 and intermediate section 64 and 65. Similarly, panel/wall member 61 comprises end sections 66 and 67 and intermediate section 68 and 69. In addition, end sections 62 and 63 and 66 and 67 are interconnected to each other along fold the line 70, while end section 62 and intermediate section 64 and end section 66 and intermediate section 68 are interconnected to each other along fold line 71. Finally, end section 63 and intermediate section 65 and end section 67 and intermediate section 69 are interconnected to each other along fold line 72.

By employing this construction, each of the sections forming panel/wall members 60 and 61 are capable of arcuately pivoting or articulating relative to each in order to enable housing 21 to be quickly and easily moved from its fully folded, two-dimensional position into its fully displayed, three-dimensional position. In order to assure this smooth, trouble-free, desired movement, end section 62 is affixed to sidewall 55 of housing 21, while end section 63 is affixed to sidewall 58.

In addition, end section 66 is affixed to sidewall 56 of housing 21, while end section 67 is affixed to sidewall 57. In this way, wall/panel members 60 and 61 are placed in juxtaposed, spaced, facing relationship with each other, ready for being placed in cooperating, locked interengagement.

In order to achieve the desired locked interengagement of wall/panel members 60 and 61, wall/panel member 60 incorporates tab member 75 extending from intermediate section 64 along fold line 70, while wall/panel member 61 incorporates tab member 76 extending from intermediate section 69 along fold line 70. In addition, tab member 75 incorporates magnetic member 77 affixed thereto, while tab member 76 incorporates magnetic member 78 affixed thereto. By forming tab members 75 and 76 in position for cooperating relationship with each other, and affixing magnetic members 77 and 78 to their respective tab members for cooperating contacting interengagement with each other, the desired secure, locked automatic contact locking engagement is realized.

By employing this embodiment of the present invention, whenever housing 21 is moved from a substantially flat two-dimensional configuration into its three-dimensional displaying position, magnetic member 77 and 78 are automatically brought into cooperating alignment with each other, enabling magnetic members 77 and 78 to be automatically drawn towards each other in secured and locked interengagement. In this way, housing 21 is automatically locked in its three-dimensional, fully displaying position, enabling the user to fully enjoy and appreciate the interest generating, eye-catching, visual display printed on the outside surfaces of housing 21. In addition, by employing magnetic member 77 and 78 to provide the locked interengagement of housing 21 in its three-dimensional position, repeated movement of housing 21 between its two-dimensional position and its three-dimensional position is easily attained, while also providing a long-lasting, construction which can be repeatedly employed without loss of strength or degradation of any kind.

In FIGS. 9-11, an alternate construction for strut forming, foldable, internal wall/panel members 60 and 61 is depicted. In this embodiment, housing 21 is constructed substantially identically to housing 21 of FIG. 6. However, in this embodiment, strut forming, foldable, interior wall/panel members 60 and 61 comprise a generally L-shaped construction consisting of sections 80 and 81 which are pivotally mounted to each other. In this regard, sections 80 and 81 of wall/panel member 60/61 are constructed for arcuate pivoting movement relative to each other about fold lines 82.

As shown, in the preferred construction of this embodiment, section 80 of wall/panel member 60 is mounted to sidewall 55 of housing 21, while section 81 of wall/panel members 61 is mounted to sidewall 57 of housing 21. By mounting wall/panel members 60 and 61 on opposite facing walls of housing 21, the desired arcuate pivoting movement of wall/panel members 60 and 61 is achieved enabling housing 21 to quickly and easily move from the substantially flat two-dimensional position, depicted in FIG. 10, to the fully erect, displaying position depicted in FIGS. 9 and 11.

In addition, in order to provide the desired secure, locked interengagement of wall/panel members 60 and 61 with each other, for securely maintaining housing 21 in its fully erect, displaying, three-dimensional configuration, magnetic members 83 and 84 are affixed to sections 80 of each wall/panel members 60 and 61. As shown, magnetic members 83 and 84 are separately mounted to each section 80 of wall/panel members 60 and 61 in position for cooperating contacting and locking interengagement with each other whenever housing 21 it is moved from its two-dimensional configuration into its three-dimensional configuration.

In this way, assurance is provided that any time a user wishes to move this embodiment of housing 21 from its collapsed, two-dimensional position into its fully displayed three-dimensional position, magnetic members 83 and 84 are automatically brought into alignment with each other. In this way, magnetic members 83 and 84 are drawn into locking contact with each other, to secure and maintain housing 21 in the desired fully erect, three-dimensional position.

As detailed above, advertising/promotional display systems 20 of the present invention is capable of being implemented in a wide variety of alternate constructions and configurations. In order to exemplify the unique attributes and broad versatility of the present invention, FIGS. 12-19 are presented. As depicted in each of these figures, a completely different, alternate configuration for advertising/promotional display system 20 is depicted. Although alternate shapes, configurations, and interior strut forming, foldable, wall/panel members are employed and depicted, the common features employed in each of these embodiments is immediately apparent. As a result, it is evident that the unique attributes of the present invention can be widely employed for achieving great versatility and constructing eye-catching, visually distinguishable, interest generating advertising/promotional display systems.

In addition to the versatility of the size, shape, configuration, and visual impact provided by advertising/promotional display system 20 of the present invention, it should also be understood that the magnetic members shown and described in this application for securing and maintaining advertising/promotional display system 20 in the fully erect, three-dimensional configuration are preferred for each of the embodiments. However, alternate locking elements can be mounted to the strut forming, wall/panel members employed in a particular housing with equal efficacy. Consequently, these alternate locking elements are hereby considered to constitute a part of the present invention.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. An advertising/promotional product comprising:

A. a housing comprising a plurality of panels cooperatively associated with each other for being movable between a first, collapsed, substantially two-dimensional configuration into a second, fully erect, three-dimensional configuration, said three-dimensional configuration establishing a desired visual display formed on the outside surfaces of the panels and a substantially closed interior zone formed by the inside surfaces of the panels;

B. a first support strut mounted inside the housing and constructed for being moved between a first folded position and a second extended position, said second extended position being defined by a major portion of said first support strut being wholly contained within and freely movable within the interior zone of the housing and comprising a) a first section and a second section cooperatively associated with each other and mounted in side by side adjacent relationship to each other with a portion of the first section being mounted to a first panel of the housing, b) said second section extending from the first section and being positioned completely within a center portion of the interior zone of the housing free of any securements or attachments when said housing is in its fully erect, three-dimensional configuration, and c) a first magnetic element securely affixed to said second section and positioned for being maintained in the interior zone of the housing when said housing is in its fully erect, three-dimensional configuration; and C. a second support strut mounted inside the housing constructed for being moved between a first folded position and a second extended position, said second extended position being defined by a major portion of said second support strut being wholly contained within and freely movable within the interior zone of the housing, and comprising a) a first section and a second section cooperatively associated with each other and mounted in side by side adjacent relationship to each other with a portion of the first section being mounted to a second panel of the housing, b) said second section extending from the first section and being positioned completely within a center portion of the interior zone of the housing free of any securements or attachments when said housing is in its fully erect, three-dimensional configuration, and c) a second magnetic element securely affixed to said second section and positioned for being maintained in the interior zone of the housing when said housing is in its fully erect, three-dimensional configuration and positioned for cooperative, interconnected engagement with the first magnetic element whenever the second magnetic element and the first magnetic element are brought into proximity with each other, whereby an advertising/promotional product is achieved which is quickly and easily fully erected in its second, three-dimensional position and securely maintained in said second position by the contacting, interengagement of said first and second magnetic elements.

2. The advertising/promotional product defined in claim 1, wherein said panels forming the housing are further defined as being affixed to at least one adjacent panel along at least one side edge, for enabling the rapid movement between the first, collapsed position and the second, fully erect, display position.

3. The advertising/promotional product defined in claim 2, wherein each of the panels forming the housing are further defined as comprising at least one shape selected from the group consisting of triangles, squares, rectangles, pentagons, hexagons, octagons, trapezoids, polygons, circles, and ellipses.

4. The advertising/promotional product defined in claim 1, wherein the first support strut and the second support strut are each further defined as comprising a substantially L-shaped construction formed by the first section and the second sections being cooperatively associated with each other and movable along a common fold line, with said first section being affixed to one panel of the housing and the second section being freely movable in the center portion of the interior zone of the housing, acuately pivotable relative to the first section. and incorporating the magnetic element mounted along a free edge thereof.

5. The advertising/promotional product defined in claim 4, wherein the first support strut and the second support strut are mounted to separate panels of the housing for extending therefrom into the center portion of the interior zone of the housing when the housing is in its fully erected position and positioned for cooperating contacting engagement of the magnetic elements with each other whenever the housing is moved from its first, collapsed, two-dimensional configuration into its second, fully erect, three-dimensional configuration.

6. The advertising/promotional product defined in claim 1, wherein the first support strut and the second support strut are each further defined as comprising four sections cooperatively associated with each other and mounted in side by side adjacent relationship, with two of the sections of each of said support struts being affixed to separate panels of the housing.

7. The advertising/promotional product defined in claim 6, wherein the first support strut and the second support strut are further defined as comprising three fold lines formed substantially parallel to each other for defining the four sections and enabling each support strut to move from a first, folded, substantially Z-shaped configuration to a second, unfolded, extended position with two sections thereof extending inwardly from the panels forming the housing into the interior zone of the housing, with said two sections being wholly contained within the center portion of the interior zone and free of any securements or attachments.

8. The advertising/promotional product defined in claim 7, wherein the first support strut and the second support strut each comprise the magnetic element mounted along the fold line formed by the two sections extending into the interior zone of the housing, whereby the magnetic element mounted to each of said support struts are positioned for contacting interengagement with each other whenever the advertising/promotional product is placed in its second, fully erect, three-dimensional configuration.

9. The advertising/promotional product defined in claim 1, wherein each support strut is further defined as being formed from material having a sufficient thickness to provide rigidity to the support structure for maintaining the housing in its fully erect position.

10. The advertising/promotional product defined in claim 9, wherein each support strut is formed from heavy-duty cardboard.

11. The advertising/promotional product defined in claim 1, wherein each magnetic element is further defined as comprising a permanent magnet having a size and shape for optimizing its performance in aligned relationship with cooperating magnets.

12. The advertising/promotional product defined in claim 11, wherein each magnetic element is further defined as comprising a shape selected from the group consisting of circles, squares, rectangles, triangles, rods, and spheres.

13. The advertising/promotional product defined in claim 1, wherein both the first magnetic element and the second magnetic element are further defined as comprising a plurality of separate and independent magnets mounted along the edge of the support strut.

14. The advertising/promotional product defined in claim 13, wherein the magnets are constructed for being attracted to each other for providing automatic contacting interengagement whenever the magnets are positioned in close proximity to each other.

15. The advertising/promotional product defined in claim 1, wherein each of the panel members forming the housing are further defined as comprising outer, exposed surfaces on which any desired indicia is displayed, for providing an exciting, interest generating, and effective advertising/promotional product.

16. The advertising/promotional product defined in claim 15, wherein said indicia comprises one or more selected from the group consisting of printed matter, messages, colors, slogans, logos, graphics, and cutouts.

17. The advertising/promotional product defined in claim 1, wherein said housing is further defined as being quickly and easily converted from a substantially flat, coplanar structure into a fully erect, three-dimensional display configuration wherein the housing is constructed for being formed into any desired overall size and shape.

18. An advertising/promotional product comprising:

A. a housing comprising a plurality of panels cooperatively associated with each other for being movable between a first, collapsed, substantially two-dimensional configuration into a second, fully erect, three-dimensional configuration, said three-dimensional configuration establishing a desired visual display formed on outside surfaces of the panels and a substantially closed interior zone formed by inside surfaces of the panels, B. a first support strut mounted inside the housing and constructed for being moved between a first folded position and a second extended position, said second extended position being defined by a major portion of said first support strut being wholly contained within and freely movable within the interior zone of the housing and a) comprising four sections cooperatively associated with each other and mounted in side by side adjacent relationship to each other forming a substantially continuous, elongated member incorporating three fold lines for defining and separating said sections, b) a first of said four sections forming a first end section, said first end section being mounted to a first panel of the housing, c) a second of said four sections forming a second end section, said second end section being mounted to a second panel of the housing, d) a third section and a fourth section mounted to each other and extending between said first end section and said second end section and being positioned completely within the interior zone of the housing free of any securements or attachments, and e) a first magnetic element mounted to the third section; and C. a second support strut mounted inside the housing and constructed for being moved between a first folded position and a second extended position, said second extended position being defined by a major portion of said second support strut being wholly contained within and freely movable within the interior zone of the housing and a) comprising four sections cooperatively associated with each other and mounted in side by side adjacent relationship to each other forming a substantially continuous, elongated member incorporating three fold lines for defining and separating said sections, b) a first of said four sections forming a first end section, said first end section being mounted to a third panel of the housing, c) a second of said four sections forming a second end section, said second end section being mounted to a fourth panel of the housing, d) a third section and a fourth section mounted to each other and extending between said first end section and said second end section and being positioned completely within the interior zone of the housing free of any securements or attachments, and e) a second magnetic element mounted to the third section and positioned for cooperative, interconnected engagement with the first magnetic element whenever the second magnetic element in the first magnetic element are brought into proximity with each other, whereby an advertising/promotional product is achieved which is quickly and easily fully erected in its second, three-dimensional position and securely maintained in said second position virtually automatically by the contacting interengagement of said first and second magnetic elements.

19. The advertising/promotional product defined in claim 18, wherein the first magnetic element is mounted on the side edge of the third section of the first support strut in close proximity to the fourth section, and the second magnetic element is mounted on the side edge of the third section of the second support strut in close proximity to the fourth section.

* * * * *